US009725882B2

(12) United States Patent
Lee

(10) Patent No.: US 9,725,882 B2
(45) Date of Patent: Aug. 8, 2017

(54) DEVICE AND METHOD FOR CONTROLLING FLOW RATE IN CONSTRUCTION MACHINERY

(71) Applicant: VOLVO CONSTRUCTION EQUIPMENT AB, Eskilstuna (SE)

(72) Inventor: Chun-Han Lee, Gimhae-si (KR)

(73) Assignee: VOLVO CONSTRUCTION EQUIPMENT AB (SE)

( * ) Notice: Subject to any disclaimer, the term of this patent is extended or adjusted under 35 U.S.C. 154(b) by 0 days.

(21) Appl. No.: 14/762,287

(22) PCT Filed: Jan. 24, 2013

(86) PCT No.: PCT/KR2013/000546
§ 371 (c)(1),
(2) Date: Jul. 21, 2015

(87) PCT Pub. No.: WO2014/115907
PCT Pub. Date: Jul. 31, 2014

(65) Prior Publication Data
US 2015/0322648 A1 Nov. 12, 2015

(51) Int. Cl.
*E02F 9/00* (2006.01)
*E02F 9/22* (2006.01)
(Continued)

(52) U.S. Cl.
CPC ..... *E02F 9/2203* (2013.01); *E02F 3/436* (2013.01); *E02F 9/2228* (2013.01);
(Continued)

(58) Field of Classification Search
CPC ..... E02F 9/2203; E02F 9/2228; E02F 9/2235; E02F 9/2296; E02F 3/436; E02F 9/2221;
(Continued)

(56) References Cited

U.S. PATENT DOCUMENTS 3,251,277 A * 5/1966 Stacey ..... E02F 3/433 137/596.12
3,411,536 A * 11/1968 Tennis ..... F15B 11/006 137/596.15
(Continued)

FOREIGN PATENT DOCUMENTS

JP H07-259806 A 10/1995
JP 2001-124011 A 5/2001
JP 2004-301214 A 10/2004

OTHER PUBLICATIONS

International Search Report (in English and Korean) and Written Opinion of the International Searching Authority (in Korean) for PCT/KR2013/000546, mailed Jun. 14, 2013; ISA/KR.

*Primary Examiner* — Fadey Jabr
*Assistant Examiner* — Angelina Shudy
(74) *Attorney, Agent, or Firm* — Harness, Dickey & Pierce, P.L.C.

(57) ABSTRACT

A flow control apparatus and a flow control method for a construction machine are disclosed, which can perform ground leveling work for smoothing the ground by the self weight of a boom without supplying hydraulic fluid from a hydraulic pump to a hydraulic cylinder. The flow control method for a construction machine including a hydraulic pump, a hydraulic actuator connected to the hydraulic pump, a control valve controlling a flow direction of hydraulic fluid supplied to the hydraulic actuator, a work mode switching valve installed in a flow path between the control valve and the hydraulic actuator to perform switching between a normal work mode and a floating mode, a detection means for detecting a boom-down operation amount of an operation lever operated by a user, an electronic proportional valve controlling a discharge flow rate of the hydraulic pump, and a controller, the flow control method including a first step of determining whether the present mode is
(Continued)

switched to the floating mode; a second step of changing the discharge flow rate of the hydraulic pump corresponding to the boom-down operation amount detected by the detection means if the present mode is switched to the floating mode; and a third step of outputting an electrical control signal to the electronic proportional valve so that the hydraulic pump can discharge the hydraulic fluid at the changed flow rate corresponding to the boom-down operation amount.

6 Claims, 3 Drawing Sheets

(51) Int. Cl.
*F15B 11/024* (2006.01)
*F15B 11/16* (2006.01)
*F15B 13/044* (2006.01)
*E02F 3/43* (2006.01)

(52) U.S. Cl.
CPC ..... *E02F 9/2235* (2013.01); *E02F 9/2296* (2013.01); *F15B 11/024* (2013.01); *F15B 11/161* (2013.01); *F15B 13/044* (2013.01); *F15B 2211/20546* (2013.01); *F15B 2211/3058* (2013.01); *F15B 2211/428* (2013.01); *F15B 2211/6346* (2013.01); *F15B 2211/6652* (2013.01); *F15B 2211/6654* (2013.01); *F15B 2211/6658* (2013.01)

(58) Field of Classification Search
CPC .... F15B 11/024; F15B 11/161; F15B 13/044; F15B 2211/20546; F15B 2211/3058; F15B 2211/428; F15B 2211/6346; F15B 2211/6652; F15B 2211/6654; F15B 2211/6658
USPC ..... 701/50
See application file for complete search history.

(56) References Cited

U.S. PATENT DOCUMENTS 3,768,372 A * 10/1973 McMillen ..... F15B 11/16 414/699
5,331,882 A 7/1994 Miller
5,598,648 A * 2/1997 Moriya ..... E02F 3/437 37/348
6,092,454 A * 7/2000 Vande Kerckhove E02F 9/2203 91/447
6,202,014 B1 * 3/2001 Brandt ..... E02F 3/3414 172/12
6,389,953 B1 * 5/2002 Altman ..... B66F 9/22 414/708
8,807,013 B2 * 8/2014 Sohn ..... E02F 9/2207 91/437
9,352,743 B2 * 5/2016 Davis ..... F15B 21/14
2001/0015129 A1 * 8/2001 Altman ..... B66F 9/22 91/525
2003/0230082 A1 * 12/2003 Wook Kim ..... E02F 9/2203 60/429
2006/0263189 A1 * 11/2006 Vigholm ..... E02F 9/2004 414/685
2007/0180821 A1 * 8/2007 Florean ..... E02F 3/3408 60/470
2009/0071666 A1 * 3/2009 Ehrhart ..... A01B 63/1013 172/1
2010/0313557 A1 12/2010 Kim
2011/0202232 A1 * 8/2011 Busch ..... A01B 63/00 701/36
2011/0220231 A1 * 9/2011 Sohn ..... E02F 9/2207 137/637
2013/0035828 A1 * 2/2013 Tamura ..... B60P 1/162 701/50
2013/0090771 A1 4/2013 Kim et al.
2013/0116897 A1 5/2013 Lee et al.
2013/0269332 A1 10/2013 Suk et al.
2014/0150416 A1 6/2014 Lee
2014/0158235 A1 6/2014 Suk et al.
2014/0174071 A1 6/2014 Lee
2014/0244118 A1 8/2014 Lee
2014/0360174 A1 * 12/2014 Sohn ..... E02F 9/2203 60/464
2015/0134209 A1 5/2015 Lee
2015/0176251 A1 6/2015 Lee
2015/0252554 A1 * 9/2015 Sato ..... F15B 21/14 60/414
2015/0315768 A1 * 11/2015 Jeong ..... E02F 9/2285 60/429
2015/0354174 A1 * 12/2015 Lee ..... E02F 9/2253 701/50
2015/0370254 A1 * 12/2015 Lee ..... E02F 9/2079 701/41
2016/0222633 A1 * 8/2016 Kang ..... E02F 9/2203
2016/0251830 A1 * 9/2016 Son ..... E02F 9/2203
2016/0333551 A1 * 11/2016 Joung ..... E02F 9/2207
2017/0016460 A1 * 1/2017 Jung ..... G05D 7/0635

* cited by examiner

DEVICE AND METHOD FOR CONTROLLING FLOW RATE IN CONSTRUCTION MACHINERY

TECHNICAL FIELD

The present invention relates to a device and method for controlling flow rate in construction machinery, and more particularly, to a flow control apparatus and a flow control method for a construction machine, which can perform ground leveling work for smoothing the ground by the self weight of a boom without supplying hydraulic fluid from a hydraulic pump to a hydraulic cylinder.

BACKGROUND OF THE INVENTION

In general, a boom floating function means a function in which a bucket moves up and down along an uneven surface of the ground only by the self weight of a boom even if an operator performs boom-down operation during working. That is, in the case where an arm is operated in forward and backward directions and the boom-down operation is performed, a bucket surface moves along the uneven surface of the ground without cutting the uneven surface through the floating function.

Through this, if a floating mode is selected by an operator depending on a work type, ground leveling work can be performed in a state where hydraulic fluid is not supplied from a hydraulic pump, whereas if a normal excavating work mode is selected, the floating mode is released and the hydraulic fluid is supplied from the hydraulic pump to perform the corresponding work. In the case of performing the ground leveling work through switching to the floating mode, the hydraulic fluid of the hydraulic pump is not used, and thus work efficiency and productivity can be heightened.

On the other hand, in the case of switching to the floating mode, it is not possible to perform a work to scrape down a wall surface by the bucket or a jack-up work to lift a body of the equipment (lower driving structure and upper swing structure) in a state where the bucket comes in contact with the ground, and thus it is required for the operator to switch the equipment to a normal work mode to cause inconvenience in use.

FIG. 1 is a graph explaining a discharge flow rate of a hydraulic pump in the case where an excavator is switched to a floating mode in the related art. In the case where the present mode is switched to a floating mode in which ground leveling work for smoothing the ground can be performed without supplying hydraulic fluid from a hydraulic pump to a hydraulic cylinder, the flow rate is calculated only through an operation of an arm (see curve "b" in the graph) even if there is a boom-down operation signal (see curve "a" in the graph), and thus the discharge amount of the hydraulic pump is reduced (see curve "c" in the graph) if a time when the operation amount of the arm is reduced arrives.

SUMMARY OF THE INVENTION

Accordingly, the present invention has been made to solve the aforementioned problems occurring in the prior art, and it is an object of the present invention to provide a flow control apparatus and a flow control method for a construction machine, which can improve operability and reduce fuel consumption by reducing a discharge flow rate of a hydraulic pump in response to reduction of a boom-down operation amount in the case of performing ground leveling work for smoothing the ground through selection of a floating mode.

It is another object of the present invention to provide a flow control apparatus and a flow control method for a construction machine, which can improve work efficiency by automatically switching activation and inactivation of a work mode in accordance with a work type.

TECHNICAL SOLUTION

To achieve the above objects, in accordance with an embodiment of the present invention, there is provided a flow control method for a construction machine including a hydraulic pump, a hydraulic actuator connected to the hydraulic pump, a control valve controlling a flow direction of hydraulic fluid supplied to the hydraulic actuator, a work mode switching valve installed in a flow path between the control valve and the hydraulic actuator to perform switching between a normal work mode and a floating mode, a detection means for detecting a boom-down operation amount of an operation lever operated by a user, an electronic proportional valve controlling a discharge flow rate of the hydraulic pump, and a controller, which includes a first step of determining whether the present mode is switched to the floating mode; a second step of changing the discharge flow rate of the hydraulic pump corresponding to the boom-down operation amount detected by the detection means if the present mode is switched to the floating mode; and a third step of outputting an electrical control signal to the electronic proportional valve so that the hydraulic pump can discharge the hydraulic fluid at the changed flow rate corresponding to the boom-down operation amount.

In accordance with another embodiment of the present invention, there is provided a flow control method for a construction machine including a hydraulic pump, a hydraulic actuator connected to the hydraulic pump, a control valve controlling a flow direction of hydraulic fluid supplied to the hydraulic actuator, a work mode switching valve installed in a flow path between the control valve and the hydraulic actuator to perform switching between a normal work mode and a floating mode, an automatic mode setting means for selecting activation or inactivation of a function of the work mode switching valve, a detection means for detecting an operation amount of an operation lever operated by an operator, a pressure detection means for detecting a load pressure of the hydraulic actuator, and a controller, which includes a first step of receiving an input of a boom-down operation signal by the operation of the operation lever when the automatic mode is set, and switching the work mode switching valve to the normal work mode if pressure in a large chamber of a boom cylinder by the pressure detection means is lower than a set pressure; and a second step of receiving an input of a boom-up operation signal that is input once or more by the operation of the operation lever when the automatic mode is set, and switching the work mode switching valve to the floating mode if the boom-down operation signal is not input by the operation of the operation lever and the pressure in the large chamber of the boom cylinder by the pressure detection means is higher than the set pressure.

Any one of a potentiometer, an angle sensor, a pressure sensor, and a digital signal may be used as the detection means for detecting the boom-down operation amount through the operation of the operation lever.

In accordance with still another embodiment of the present invention, there is provided a flow control apparatus for a construction machine, which includes: a hydraulic pump connected to an engine; a hydraulic actuator connected to the hydraulic pump; a control valve installed in a flow path between the hydraulic pump and the hydraulic actuator and switched to control a start, a stop, and a direction change of the hydraulic actuator; a work mode switching valve installed in a flow path between the control valve and the hydraulic actuator and switched to a normal work mode or a floating mode; an electronic valve switching the work mode switching valve to the normal work mode or the floating mode: an automatic mode setting means for selecting activation or inactivation of a function of the work mode switching valve; a detection means for detecting an operation amount of an operation lever operated by an operator; a pressure detection means for detecting a load pressure of the hydraulic actuator; and a controller outputting a control signal to the electronic valve so as to automatically switch the work mode switching valve to the normal work mode or the floating mode in accordance with working conditions that are determined by the operation amount of the operation lever input through the detection means and the load pressure of the hydraulic actuator input through the pressure detection means when the operator sets a function of the work mode switching valve to an automatic mode through an operation of the automatic mode setting means.

If the automatic mode is set by the operation of the automatic mode setting means, a boom-down operation signal may be input by the operation of the operation lever, and if pressure in a large chamber of a boom cylinder that is detected by the pressure detection means is lower than a set pressure, the work mode switching valve may be automatically switched to the normal work mode; and if the automatic mode is set by the operation of the automatic mode setting means, a boom-up operation signal may be input once or more by the operation of the operation lever, and if the boom-down operation signal is not input by the operation of the operation lever and the pressure in the large chamber of the boom cylinder that is detected by the pressure detection means is higher than the set pressure, the work mode switching valve may be automatically switched to the floating mode.

A valve that is switched by a hydraulic signal input from an outside or a valve that is switched by an electric signal input from the outside may be used as the work mode switching valve.

A pressure sensor or a pressure switch may be used as the detection means for detecting the load of the hydraulic actuator.

Any one of a potentiometer, an angle sensor, a pressure sensor, and a digital signal may be used as the detection means for detecting the boom-down operation amount through the operation of the operation lever.

Advantageous Effect

According to embodiments of the present invention having the above-described configuration, since the discharge flow rate of the hydraulic pump is reduced without reducing the driving speed of the working device in the case of performing the ground leveling work for smoothing the ground through the selection of the floating mode, the fuel consumption can be reduced. Further, since the activation and inactivation of the work mode is automatically switched by the controller in accordance with the work type, the work efficiency can be heightened and the productivity can be increased.

BRIEF DESCRIPTION OF THE DRAWINGS

The above objects, other features and advantages of the present invention will become more apparent by describing the preferred embodiments thereof with reference to the accompanying drawings, in which.

EXPLANATION OF REFERENCE NUMERALS FOR MAIN PARTS IN THE DRAWING

Figure 1:
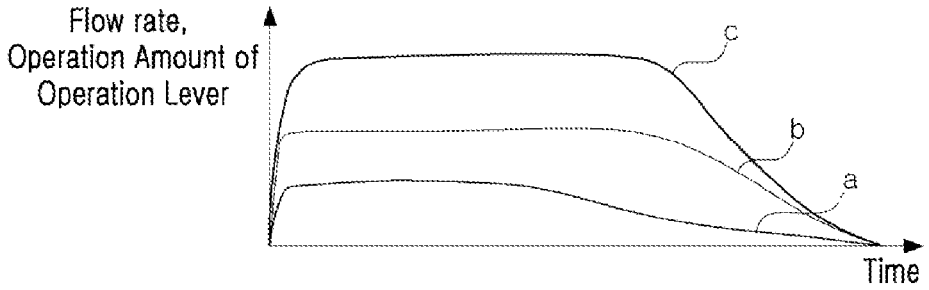
FIG. 1 is a graph explaining the discharge flow rate of a hydraulic pump in the case where an excavator is switched to a floating mode in the related.

10: hydraulic pump
11: hydraulic actuator
12: control valve
13: work mode switching valve
14: operation lever
15: electronic proportional valve
16: controller
17: electronic valve

DETAILED DESCRIPTION OF THE INVENTION

Hereinafter, a flow control apparatus and a flow control method for a construction machine in accordance with preferred embodiments of the present invention will be described in detail with reference to the accompanying drawings.

Figure 2:
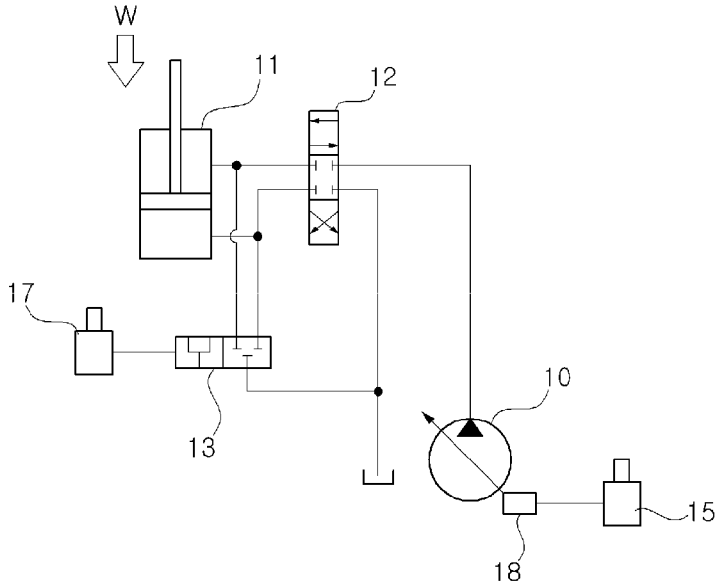
Prior Art FIG. 2
FIG. 2 is a hydraulic circuit diagram that is applied to a flow control method for a construction machine according to a preferred embodiment of the present invention.
Figure 3:
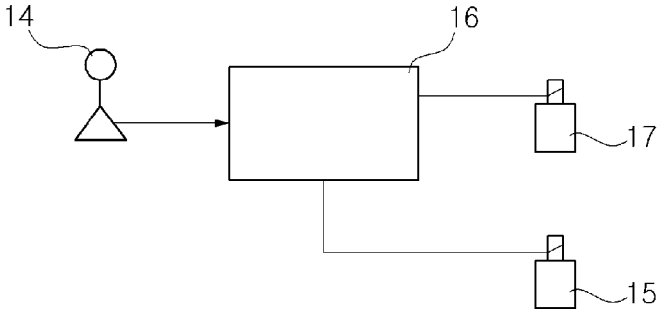
FIG. 3 is a block diagram of a flow control apparatus that is used in a flow control method for a construction machine according to a preferred embodiment of the present invention.
Figure 4:
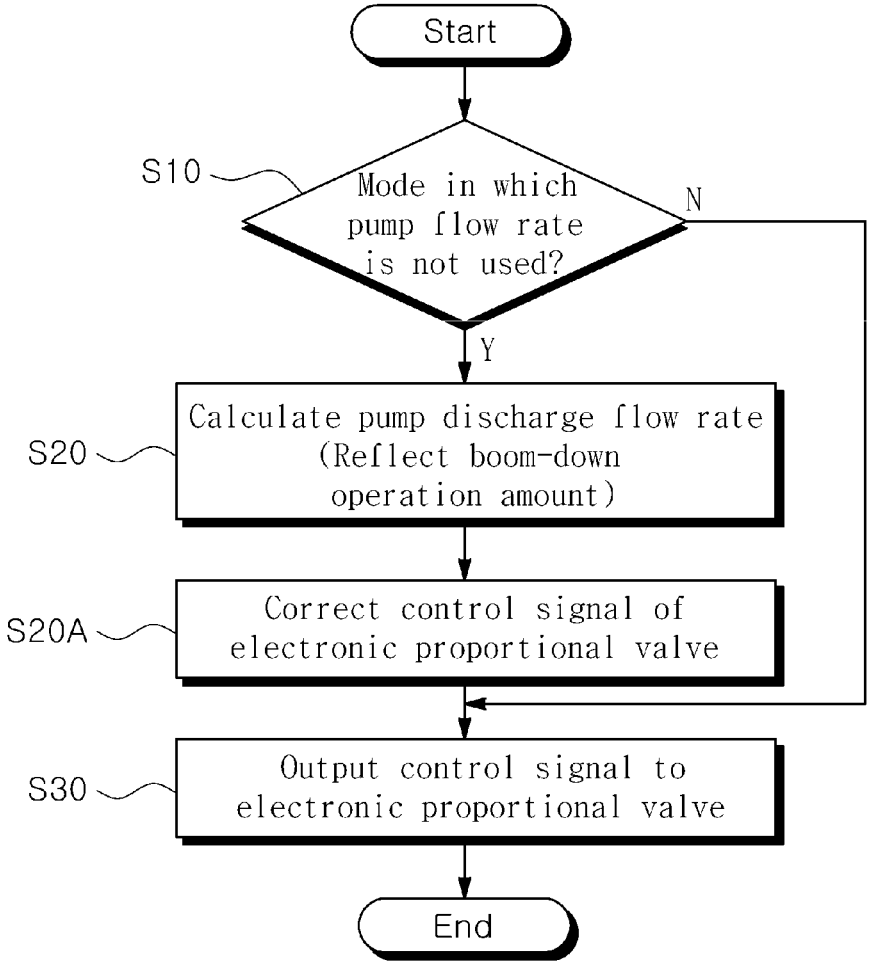
FIG. 4 is a flowchart of a flow control method for a construction machine according to another preferred embodiment of the present invention.
Figure 5:
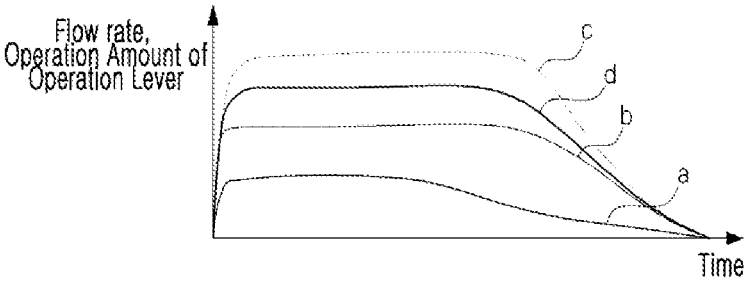
FIG. 5 is a graph explaining a discharge flow rate of a hydraulic pump in the case where an excavator is switched to a floating mode in a flow control method for a construction machine according to a preferred embodiment of the present invention.
Figure 6:
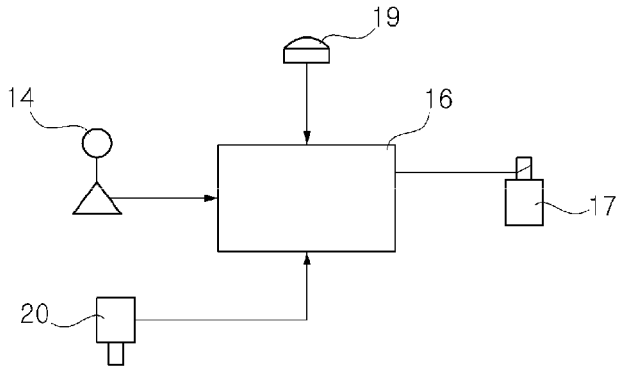
FIG. 6 is a block diagram of a flow control apparatus for a construction machine according to still another preferred embodiment of the present invention.
Figure 7:
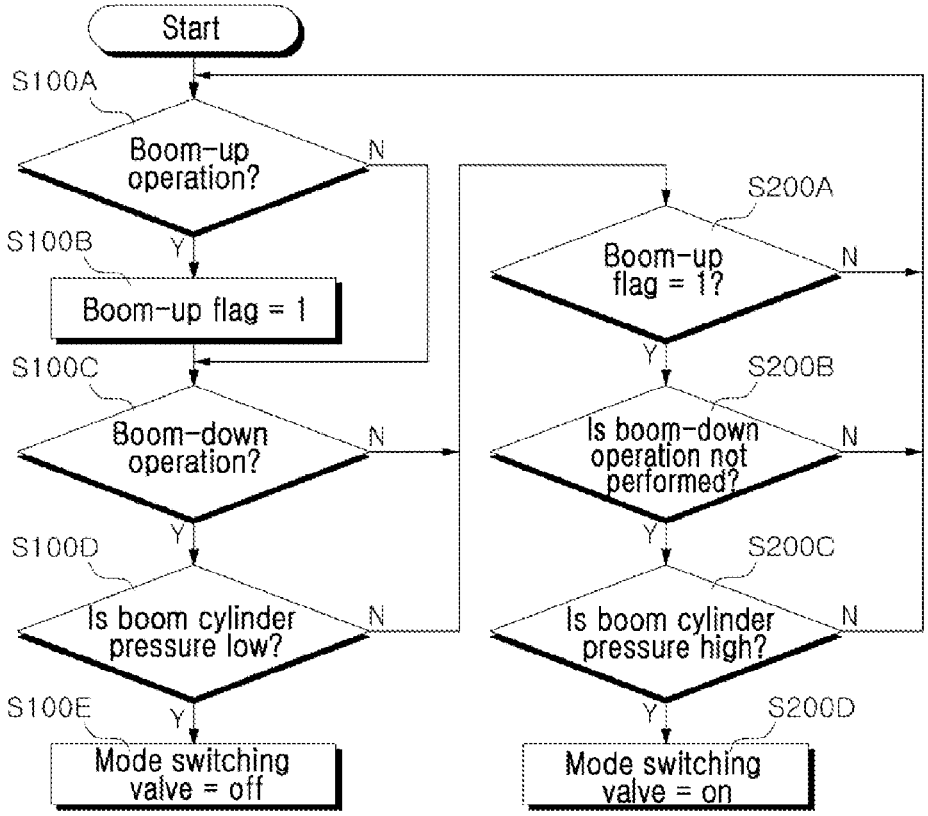
FIG. 7 is a flowchart explaining an automatic mode which can be switched to a normal work mode or a floating mode in accordance with a work type in a flow control method for a construction machine according to still another preferred embodiment of the present invention.

FIG. 2 is a hydraulic circuit diagram that is applied to a flow control method for a construction machine according to a preferred embodiment of the present invention, and FIG. 3 is a block diagram of a flow control apparatus that is used in a flow control method for a construction machine according to a preferred embodiment of the present invention. FIG. 4 is a flowchart of a flow control method for a construction machine according to another preferred embodiment of the present invention, and FIG. 5 is a graph explaining a discharge flow rate of a hydraulic pump in the case where an excavator is switched to a floating mode in a flow control method for a construction machine according to a preferred embodiment of the present invention. FIG. 6 is a block diagram of a flow control apparatus for a construction machine according to still another preferred embodiment of the present invention, and FIG. 7 is a flowchart explaining an automatic mode which can be switched to a normal work mode or a floating mode in accordance with a work type in a flow control method for a construction machine according to still another preferred embodiment of the present invention.

Referring to FIGS. 2 to 5, according to an embodiment of the present invention, there is provided a flow control method for a construction machine including a hydraulic pump 10 connected to an engine (not illustrated), a hydraulic actuator 11 connected to the hydraulic pump 10, a control valve 12 installed in a flow path between the hydraulic pump 10 and the hydraulic actuator 11 and switched to control a start, a stop, and a direction change of the hydraulic actuator 11, a work mode switching valve 13 installed in a flow path between the control valve 12 and the hydraulic actuator 11 to perform switching between a normal work mode and a floating mode, a detection means for detecting a boom-down operation amount of an operation lever 14 operated by a user, an electronic proportional valve 15 controlling a discharge flow rate of the hydraulic pump 10, a controller 16, and an electronic valve 17 outputting a control signal so as to switch the work mode switching valve 13, which includes a first step S10 of determining whether the present mode is switched to the floating mode; a second step S20 and S20A of changing the discharge flow rate of the hydraulic pump 10 corresponding to the boom-down operation amount detected by the detection means and correcting an electrical control signal value that is output to the electronic proportional valve 15 corresponding to the changed discharge flow rate if the present mode is switched to the floating mode; and a third step S30 of outputting the electrical control signal to the electronic proportional valve 15 so that the hydraulic pump 10 can discharge the hydraulic fluid at the changed flow rate corresponding to the boom-down operation amount.

In the case where an operator operates the operation lever 14, any one of a potentiometer, an angle sensor, a pressure sensor, and a digital signal may be used as the detection means for detecting the boom-down operation amount.

In the drawing, an unexplained reference numeral 18 denotes a regulator that variably controls an inclination angle of a swash plate of the hydraulic pump 10 so as to discharge the hydraulic fluid from the hydraulic pump 10 corresponding to a secondary pressure that is output from the electronic proportional valve 15.

According to the above-described configuration, as in the first step S10, it is determined whether the present mode is switched to the floating mode. If a spool of the work mode switching valve 13 is switched in a rightward direction in the drawing by signal pressure that is output from the electronic valve 17 and the present mode is switched to the floating mode, the processing proceeds to the second step S20, whereas if the present mode is not switched to the floating mode (if the spool of the work mode switching valve 13 maintains a state as illustrated in FIG. 2), the processing proceeds to the third step S30.

As in the second step S20, if the present mode is switched to the floating mode, the discharge flow rate of the hydraulic pump 10 is calculated corresponding to the boom-down operation amount detected by the detection means as the operator operates the operation lever 14. In this case, any one of a potentiometer, an angle sensor, a pressure sensor, and a digital signal may be used as the detection means. Since the detection means as described above is known in the art, the detailed explanation thereof will be omitted.

As in the second step S20A, the electrical control signal value that is output to the electronic proportional valve 15 is corrected so as to discharge the flow rate that is calculated corresponding to the boom-down operation amount from the hydraulic pump 10.

As in the third step S30, the electrical control signal is output to the electronic proportional valve 15 so that the hydraulic pump 10 can discharge the hydraulic fluid with the flow rate that corresponds to the boom-down operation amount.

As shown in the graph of FIG. 5, if the boom-down operation signal is sensed in the case where the present mode is switched to a floating mode in which ground leveling work is performed using the self weight of a boom, a control signal is output to the electronic proportional valve 15 to reduce the flow rate of the hydraulic pump (see curve "d" in the graph). That is, in the case where the boom-down operation and an arm-out operation are simultaneously performed in a normal work mode, a part of the flow rate of the hydraulic pump is supplied to an arm cylinder and another part of the flow rate of the hydraulic pump is supplied to a boom cylinder, so that an arm driving speed is lowered in comparison to a single operation state. In contrast, in the case where the present mode is switched to the floating mode, the flow rate of the hydraulic pump is reduced in proportion to the boom-down operation amount. Through this, the arm driving speed in the floating mode becomes equal to the arm driving speed in the normal work mode, and thus the operator can maintain the same workability to reduce fuel ratio.

Referring to FIGS. 2 and 5, according to another embodiment of the present invention, there is provided a flow control apparatus for a construction machine, which includes a hydraulic pump 10 connected to an engine (not illustrated); a hydraulic actuator 11 connected to the hydraulic pump 10; a control valve 12 installed in a flow path between the hydraulic pump 10 and the hydraulic actuator 11 and switched to control a start, a stop, and a direction change of the hydraulic actuator; a work mode switching valve 13 installed in a flow path between the control valve 12 and the hydraulic actuator 11 and switched to a normal work mode or a floating mode; an electronic valve 17 switching the work mode switching valve 13 to the normal work mode or the floating mode: an automatic mode setting means 19 for selecting activation or inactivation of a function of the work mode switching valve 13; a detection means for detecting an operation amount of an operation lever 14 operated by an operator; a pressure detection means 20 for detecting a load pressure of the hydraulic actuator 11; and a controller 16 outputting a control signal to the electronic valve 17 so as to automatically switch the work mode switching valve 13 to the normal work mode or the floating mode in accordance with working conditions that are determined by the operation amount of the operation lever 14 input through the detection means and the load pressure of the hydraulic actuator 11 input through the pressure detection means 20 when the operator sets a function of the work mode switching valve 13 to an automatic mode through an operation of the automatic mode setting means 19.

In this case, since the configuration except for the detection means for detecting the operation amount of the operation lever 14, the automatic mode setting means 19, and the pressure detection means 20 is the same as the configuration of the hydraulic circuit for a construction machine as illustrated in FIG. 2, the detailed explanation thereof will be omitted, and the same reference numerals are given to the same constituent elements.

If the automatic mode is set by the operation of the automatic mode setting means 19, a boom-down operation signal may be input by the operation of the operation lever 14, and if pressure in a large chamber of a boom cylinder that is detected by the pressure detection means 20 is lower than a set pressure, the work mode switching valve 13 may be automatically switched to the normal work mode; and if the automatic mode is set by the operation of the automatic mode setting means 19, a boom-up operation signal may be input once or more by the operation of the operation lever 14, and if the boom-down operation signal is not input by the operation of the operation lever 14 and the pressure in the large chamber of the boom cylinder that is detected by the pressure detection means 20 is higher than the set pressure, the work mode switching valve 13 may be automatically switched to the floating mode.

Referring to FIGS. 6 and 7, according to still another embodiment of the present invention, there is provided a flow control method for a construction machine including a hydraulic pump 10 connected to an engine (not illustrated), a hydraulic actuator 11 connected to the hydraulic pump 10, a control valve 12 installed in a flow path between the hydraulic pump 10 and the hydraulic actuator 11 and switched to control a start, a stop, and a direction change of the hydraulic actuator 11, a work mode switching valve 13 installed in a flow path between the control valve 12 and the hydraulic actuator 11 to perform switching between a normal work mode and a floating mode, an automatic mode setting means 19 for selecting activation or inactivation of a function of the work mode switching valve 13, a detection means for detecting an operation amount of an operation lever (RCV lever) 14 operated by an operator, a pressure detection means 20 for detecting a load pressure of the hydraulic actuator 11, and a controller 16, which includes a first step S100A, S100B, S100C, S100D, and S100E of receiving an input of a boom-down operation signal by the operation of the operation lever 14 when the automatic mode is set, and switching the work mode switching valve 13 to the normal work mode if pressure in a large chamber of a boom cylinder by the pressure detection means 20 is lower than a set pressure; and a second step S200A, S200B, S200C, and S200D of receiving an input of a boom-up operation signal that is input once or more by the operation of the operation lever 14 when the automatic mode is set, and switching the work mode switching valve 13 to the floating mode if the boom-down operation signal is not input by the operation of the operation lever 14 and the pressure in the large chamber of the boom cylinder by the pressure detection means 20 is higher than the set pressure.

A valve that is switched by a hydraulic signal input from an outside or a valve that is switched by an electric signal input from the outside may be used as the work mode switching valve 13.

A pressure sensor or a pressure switch may be used as the detection means for detecting the load of the hydraulic actuator 11.

Any one of a potentiometer, an angle sensor, a pressure sensor, and a digital signal may be used as the detection means for detecting the operation amount of the operation lever 14.

According to the above-described configuration, as illustrated in FIGS. 2 and 6, an operation signal that is produced when an operator operates the automatic mode setting means 19, an operation signal value that corresponds to an operation amount according to the operation of the operation lever 14, and a detection signal value of a load pressure that is detected by the pressure detection means 20 are respectively input to the controller 16.

Through this, the electronic valve 17 is driven by a control signal that is output from the controller 16 in accordance with a work type, and the work mode switching valve 13 is switched in a rightward direction in FIG. 2 by a control signal that is output from the electronic valve 17 to make the work mode switching valve 13 switched to the floating mode. That is, a flow path for supplying hydraulic fluid from the hydraulic pump 10 to the hydraulic actuator 11 is intercepted by the control valve 12 having a spool that maintains a neutral state, and a large chamber and a small chamber of the hydraulic actuator 11 communicate with each other by the spool switching of the work mode switching valve 13.

As illustrated in FIG. 7, in working conditions in which the present mode is switched to the automatic mode by the automatic mode setting means 19, it is determined whether a boom-up operation signal by the operation of the operation lever 14 is input (see S100A). If the boom-up operation signal is input to the controller 16, the processing proceeds to S100B, whereas if the boom-up operation signal is not input, the processing proceeds to S100C.

If the boom-up operation signal is input as in S100B, it is stored in the controller 16 (boom-up flag=1).

As in S100C, it is determined whether a boom-down operation signal by the operation of the operation lever 14 is input. If the boom-down operation signal is input to the controller 16, the processing proceeds to S100D, whereas if the boom-down operation signal is not input, the processing proceeds to S200A.

As in S100D, it is determined whether a load pressure which is generated in the large chamber of the hydraulic actuator (i.e., boom cylinder) 11 and is detected by the pressure detection means 20 is in a low state. If the pressure that is generated in the hydraulic actuator 11 is in a low state, the processing proceeds to S100E, whereas if the pressure that is generated in the hydraulic actuator 11 is in a high state, the processing proceeds to S200A.

As in S100E, if the boom-down operation signal by the operation of the operation lever 14 is input and the pressure of the large chamber of the boom cylinder by the pressure detection means 20 is lower than the set pressure, the work mode switching valve 13 is switched to the normal work mode.

That is, since the control signal is not input from the electronic valve 17 and the work mode switching valve 13 maintains an off state to be switched to the normal work mode, the hydraulic fluid from the hydraulic pump 10 may be supplied to the actuator 11 during switching of the control valve 12. Through this, a jack-up work to lift a body of the equipment (lower driving structure and upper swing structure) may be performed in a state where the bucket comes in contact with the ground.

On the other hand, in the working conditions in which the present mode is switched to the automatic mode by the automatic mode setting means 19, it is determined whether the boom-up operation signal by the operation of the operation lever 14 is input (boom-up flag=1) as in S200A. If the boom-up operation signal is input once or more, the processing proceeds to S200B, whereas if the boom-up operation signal is not input, the processing proceeds to S100A.

As in S200B, it is determined whether a boom-down operation by the operation of the operation lever 14 is performed. If the boom-down operation is not performed, the processing proceeds to S200C, whereas if the boom-down operation is performed, the processing proceeds to S100A.

As in S200C, it is determined whether a load pressure which is generated in the large chamber of the hydraulic actuator 11 and is detected by the pressure detection means 20 is in a high state. If the pressure that is generated in the hydraulic actuator 11 is in a high state, the processing proceeds to S200D, whereas if the pressure that is generated in the hydraulic actuator 11 is in a low state, the processing proceeds to S100A.

As in S200D, if the boom-up operation signal by the operation of the operation lever 14 is input once or more, the boom-down operation signal by the operation of the operation lever 14 is not input, and the pressure of the large chamber of the boom cylinder by the pressure detection means 20 is higher than the set pressure, the electronic valve 17 is driven by the control signal from the controller 16 to switch the work mode switching valve 13 to the floating mode.

As described above, since the spool of the work mode switching valve 13 is switched to the floating mode by the control signal that is input from the electronic valve 17, the hydraulic fluid from the hydraulic pump 10 is not supplied to the hydraulic actuator 11 during the switching of the control valve 12, but the large chamber and the small chamber of the hydraulic actuator 11 communicate with each other.

Through this, the boom-down operation can be performed by the self weight of the boom without using the hydraulic fluid that is supplied from the hydraulic pump 10 during traveling.

Although the present invention has been described with reference to the preferred embodiments in the attached figures, it is noted that equivalents may be employed and substitutions made herein without departing from the scope of the invention as recited in the claims.

INDUSTRIAL APPLICABILITY

According to the present invention having the above-described configuration, in the case of performing the ground leveling work for smoothing the ground through the selection of the floating mode, the discharge flow rate of the hydraulic pump can be reduced, and the driving speed of the working device can be prevented from being deteriorated.

While the present invention has been described in connection with the specific embodiments illustrated in the drawings, they are merely illustrative, and the invention is not limited to these embodiments. It is to be understood that various equivalent modifications and variations of the embodiments can be made by a person having an ordinary skill in the art without departing from the spirit and scope of the present invention. Therefore, the true technical scope of the present invention should not be defined by the above-mentioned embodiments but should be defined by the appended claims and equivalents thereof.

What is claimed is:

1. A flow control apparatus for a construction machine comprising:

a hydraulic pump connected to an engine;

a hydraulic actuator connected to the hydraulic pump;

a control valve installed in a flow path between the hydraulic pump and the hydraulic actuator and switched to control a start, a stop, and a direction change of the hydraulic actuator;

a work mode switching valve installed in a flow path between the control valve and the hydraulic actuator and switched to a normal work mode or a floating mode;

an electronic valve switching the work mode switching valve to the normal work mode or the floating mode:

an automatic mode setting switch for selecting activation or inactivation of a function of the work mode switching valve;

a detection means for detecting an operation amount of an operation lever operated by an operator;

a pressure detection means for detecting a load pressure of the hydraulic actuator; and a controller outputting a control signal to the electronic valve so as to automatically switch the work mode switching valve to the normal work mode or the floating mode in accordance with working conditions that are determined by an operation of the operation lever input through the detection means and the load pressure of the hydraulic actuator input through the pressure detection means when the operator sets a function of the work mode switching valve to an automatic mode through an operation of the automatic mode setting switch;

wherein:

the controller is configured to automatically switch the work mode switching valve to the normal work mode when the automatic mode is set by the operation of the automatic mode setting switch, a boom-down operation signal is input by the operation of the operation lever, and pressure in a large chamber of a boom cylinder that is detected by the pressure detection means is lower than a set pressure; and the controller is configured to automatically switch the work mode switching valve to the floating mode when the automatic mode is set by the operation of the automatic mode setting switch, a boom-up operation signal is input once or more by the operation of the operation lever, the boom-down operation signal is not input by the operation of the operation lever, and the pressure in the large chamber of the boom cylinder that is detected by the pressure detection means is higher than the set pressure.

2. The flow control apparatus according to claim 1, wherein a valve that is switched by a hydraulic signal input from an outside thereof or a valve that is switched by an electric signal input from the outside thereof is used as the work mode switching valve.

3. The flow control apparatus according to claim 1, wherein a pressure sensor or a pressure switch is used as the pressure detection means for detecting the load of the hydraulic actuator.

4. The flow control apparatus according to claim 1, wherein the hydraulic actuator includes a hydraulic cylinder or a hydraulic motor.

5. The flow control apparatus according to claim 1, wherein any one of a potentiometer, an angle sensor, a pressure sensor, and a digital signal is used as the detection means for detecting the boom-down operation amount through the operation of the operation lever.

6. A flow control apparatus for a construction machine comprising:

a hydraulic pump connected to an engine;

a hydraulic actuator connected to the hydraulic pump;

a control valve installed in a flow path between the hydraulic pump and the hydraulic actuator and switched to control a start, a stop, and a direction change of the hydraulic actuator;

a work mode switching valve installed in a flow path between the control valve and the hydraulic actuator and switched to a normal work mode or a floating mode;

an electronic valve switching the work mode switching valve to the normal work mode or the floating mode:

an automatic mode setting switch for selecting activation or inactivation of a function of the work mode switching valve;

an operation lever detector for detecting an operation amount of an operation lever operated by an operator;

a pressure detector for detecting a load pressure of the hydraulic actuator; and a controller outputting a control signal to the electronic valve so as to automatically switch the work mode switching valve to the normal work mode or the floating mode in accordance with working conditions that are determined by an operation of the operation lever input through the operation lever detector and the load pressure of the hydraulic actuator input through the pressure detector when the operator sets a function of the work mode switching valve to an automatic mode through an operation of the automatic mode setting switch;

wherein:

the controller is configured to automatically switch the work mode switching valve to the normal work mode when the automatic mode is set by the operation of the automatic mode setting switch, a boom-down operation signal is input by the operation of the operation lever, and pressure in a large chamber of a boom cylinder that is detected by the pressure detector is lower than a set pressure; and the controller is configured to automatically switch the work mode switching valve to the floating mode when: (a) the automatic mode is set by the operation of the automatic mode setting switch, (b) a boom-up operation signal is input once or more by the operation of the operation lever while the boom-down operation signal is not input by the operation of the operation lever, and (c) the pressure in the large chamber of the boom cylinder that is detected by the pressure detector is higher than the set pressure.

* * * * *